US010151549B1

(12) United States Patent
Batchelor

(10) Patent No.: US 10,151,549 B1
(45) Date of Patent: Dec. 11, 2018

(54) GUN PART WITH INTEGRAL SPARE EXTRACTOR

(71) Applicant: Powder River Precision, Inc., Baker City, OR (US)

(72) Inventor: Daniel Simpson Batchelor, Baker City, OR (US)

(73) Assignee: POWDER RIVER PRECISION, INC., Baker City, OR (US)

( * ) Notice: Subject to any disclaimer, the term of this patent is extended or adjusted under 35 U.S.C. 154(b) by 0 days.

(21) Appl. No.: 15/836,981

(22) Filed: Dec. 11, 2017

Related U.S. Application Data

(60) Provisional application No. 62/707,406, filed on Nov. 2, 2017.

(51) Int. Cl.

| | |
|---|---|
| ***F41A 15/12*** | (2006.01) |
| ***F41A 35/00*** | (2006.01) |
| *F41A 99/00* | (2006.01) |
| *F41A 19/11* | (2006.01) |

(52) U.S. Cl.
CPC ..... *F41A 15/12* (2013.01); *F41A 19/11* (2013.01); *F41A 99/00* (2013.01)

(58) Field of Classification Search
CPC ..... F41A 15/06; F41A 15/08; F41A 15/10; F41A 15/12; F41A 15/14; F41A 15/16; F41A 15/22; F41A 35/00; F41A 99/00; F41C 27/00
See application file for complete search history.

(56) References Cited

U.S. PATENT DOCUMENTS

| | | | | |
|---|---|---|---|---|
| 3,564,950 A * | 2/1971 | Jorczak et al. | ..... | F41A 15/22 29/278 |
| 5,900,577 A * | 5/1999 | Robinson | ..... | F41A 11/02 89/156 |
| 7,637,049 B1 * | 12/2009 | Samson | ..... | F41A 35/00 42/107 |

(Continued)

OTHER PUBLICATIONS

Bob Newton, "How the 10/22 Bolt Lock/Release Works," The 10/22 Companion, https://1022companion.wordpress.com/2015/04/02/how-the-1022-bolt-lockrelease-works/, Posted Apr. 2, 2015, Accessed Nov. 10, 2017.

(Continued)

*Primary Examiner* — Derrick R Morgan
(74) *Attorney, Agent, or Firm* — Bennet K. Langlotz; Langlotz Patent & Trademark Works, Inc.

(57) ABSTRACT

A gun part with integral spare extractor has a planar element having a first periphery and form adapted to provide a first gun part function, the planar element including an integral and detachable removable element having a periphery adapted to provide a second gun part function, and at least a portion of the periphery of the removable element being defined by an elongated articulated opening defined in the planar element such that the removable element is connected only by a limited portion that is breakable without affecting the utility of the planar element and the removable element. The removable element may be positioned away from the first periphery such that an enclosed aperture is defined by the opening upon removal of the removable element. The opening may be an articulated cut of consistent width. The removable part may be connected to the planar element by only a single span.

19 Claims, 7 Drawing Sheets

(56) References Cited

U.S. PATENT DOCUMENTS

| | | | | |
|---|---|---|---|---|
| 2005/0188585 | A1* | 9/2005 | Vicate | F41C 3/00 42/71.01 |
| 2011/0277368 | A1* | 11/2011 | Overstreet | F41A 3/64 42/108 |
| 2013/0139424 | A1* | 6/2013 | Devine | F41A 3/26 42/16 |
| 2015/0040451 | A1* | 2/2015 | Young | F41A 15/16 42/25 |
| 2015/0260471 | A1* | 9/2015 | Azhocar | F41A 11/00 42/90 |
| 2015/0308768 | A1* | 10/2015 | Mills | F41A 11/04 42/75.03 |
| 2018/0056611 | A1* | 3/2018 | Gintert | B29C 70/541 |

OTHER PUBLICATIONS

Sturm, Ruger & Co., Inc., "Instruction Manual for Ruger(R) Model 10/22(R) Autoloading Rifles," Published Feb. 2009.

* cited by examiner

GUN PART WITH INTEGRAL SPARE EXTRACTOR

CROSS-REFERENCE TO RELATED APPLICATION

This application claims the benefit of U.S. Provisional Patent Application No. 62/707,406 filed on Nov. 2, 2017, entitled "1022 BOLT LOCK WITH EMERGENCY EXTRACTOR," which is hereby incorporated by reference in its entirety for all that is taught and disclosed therein.

FIELD OF THE INVENTION

The present invention relates to firearms, and more particularly to a gun part with integral spare extractor that can be detached from the gun part to replace a damaged extractor.

BACKGROUND OF THE INVENTION

Ruger® 10/22® rifles manufactured by Sturm, Ruger & Co., Inc. of Southport, Connecticut are one of the most successful recreational shooting rifles in history. The rifle's popularity stems from its origins as one of the first modern rifles chambered in .22 caliber that featured a quality design suitable for use by adults. Its easy handling characteristics, negligible recoil, and inexpensive ammunition make it ideal for young or inexperienced shooters. However, the rifle is also widely used by small game hunters and those who want an inexpensive rifle firing inexpensive ammunition for target and plinking use. These characteristics also make it useful as a training rifle for police and military applications. A wide range of after-market modifications are available to improve the rifle's performance, augment the rifle's appearance, and increase its magazine capacity.

The rifle's design employs an integrated modular subassembly approach depicted in FIGS. 1-3. The modular construction of the components means the average person can easily replace any part of the gun using only a screwdriver, a hex key, and simple punches.

The trigger guard assembly 122 of the 10/22® rifle 100 contains the entire firing mechanism, which features a short-throw, high-speed swinging hammer 158 for rapid lock time. The hammer is cocked by rearward motion of the bolt assembly 126. A trigger 154 releases the hammer to discharge the rifle 100. The trigger is encircled by a trigger guard 156. The trigger guard assembly is held together by trigger guard assembly pins 148 inserted in trigger guard assembly pin holes 124. The one-piece .22 Long Rifle (LR) receiver 136 is milled from a solid block of cast aluminum and is drilled and tapped for a tip-off scope mount adaptor supplied with the rifle. The bolt assembly reciprocates within the receiver. The motion of the bolt assembly 126 is controlled by a cocking handle 130 mounted on a guide rod 132 and a recoil stop pin 142 attached to the receiver. The recoil stop pin is positioned in the bolt path where it can engage with a recoil pin slot 128 in the rear 150 of the bolt 152 to limit rearward movement of the bolt. The magazine 116 is a compact rotary 10-shot unit.

The barrel 102 uses a unique attachment technique where the barrel is screwed rather than pinned into the frame. The barrel tenon 104 is not threaded, but attachment of the barrel to the receiver involves two barrel retainer screws 106 and a barrel retainer 108 with a slot 110 in its rear that is received by a slot in the underside of the barrel. The forward portion of the barrel is secured to the stock assembly 118 that includes a stock 140 by a barrel band 112 that is tightened by a barrel band screw 114. A takedown screw 120 further secures the barrel within the stock assembly. The upper portion of the barrel is left exposed by the stock assembly. This construction makes removal and replacement of the barrel, which would otherwise require a gunsmith's work with most other rifles, much easier.

The bolt assembly 126 is shown in more detail in FIG. 2. The bolt assembly includes a bolt 152 having a rear 150, left side 160, right side 162, and a front 164. An extractor 166, extractor spring 168, and extractor plunger 170 are attached to the bolt. A firing pin 144 with a firing pin rebound spring 172 is attached to the bolt by a firing pin stop pin 174 received by aperture 176. The extractor sits in a slot 178 in the front right side of the bolt. A round hole 180 across the slot receives the square tail 182 of the extractor. The extractor is pushed toward the center of the bolt by the extractor plunger on the extractor spring. The plunger fits against the outer shoulder 184 of the extractor. The extractor functions to extract an unfired cartridge from the chamber 146 by engaging the case rim when the bolt is manually cycled, and the extractor holds a discharged case in position on the bolt by engaging the case rim until the left side of the case head contacts the ejector 188 (shown in FIG. 3). Once the discharged case encounters the ejector, the case pivots about the hook portion 186 of the extractor and spins sideways out the ejection port 138. Because the rifle 100 uses a blowback action, the extractor does not pull a discharged case out of the chamber. Instead, gas pressure resulting from the discharge pushes the discharged case back against the bolt to cycle the action.

The extractor 166 supplied with the rifle 100 is prone to malfunctioning because of excessive wear or breakage of the hook portion 186. When the extractor lacks a sharp hook portion, the extractor can slip off the case rim of an unfired cartridge, thereby leaving the cartridge in the chamber when the bolt is manually cycled. Furthermore, a worn or broken extractor can be unable to hold a discharged case in proper position on the bolt 152, resulting in the discharged case failing to contact the ejector 188. As a result, the discharged case becomes stuck inside the receiver, which prevents the next round from being chambered.

When the extractor 166 malfunctions because of excessive wear or breakage, it must be replaced before the rifle 100 will operate properly. While numerous replacement extractors are available from Sturm, Ruger & Co., Inc. of Southport, Conn., as well as other companies that have sought to improve upon the extractor's design, the extractor is a small part that easy to lose or to forget to carry with the rifle 100.

Therefore, a need exists for a new and improved gun part with integral spare extractor that can be detached from the gun part to replace a damaged extractor. In this regard, the various embodiments of the present invention substantially fulfill at least some of these needs. In this respect, the gun part with integral spare extractor according to the present invention substantially departs from the conventional concepts and designs of the prior art, and in doing so provides an apparatus primarily developed for the purpose of providing a gun part with integral spare extractor that can be detached from the bolt lock to replace a damaged extractor.

SUMMARY OF THE INVENTION

The present invention provides an improved gun part with integral spare extractor, and overcomes the above-mentioned disadvantages and drawbacks of the prior art. As such, the general purpose of the present invention, which will be described subsequently in greater detail, is to provide an improved gun part with integral spare extractor that has all the advantages of the prior art mentioned above.

To attain this, the preferred embodiment of the present invention essentially comprises a planar element having a first periphery and form adapted to provide a first gun part function, the planar element including an integral and detachable removable element having a periphery adapted to provide a second gun part function, and at least a portion of the periphery of the removable element being defined by an elongated articulated opening defined in the planar element such that the removable element is connected only by a limited portion that is breakable without affecting the utility of the planar element and the removable element. The removable element may be positioned away from the first periphery such that an enclosed aperture is defined by the opening upon removal of the removable element. The opening may be an articulated cut. The cut may have a consistent width. The removable part may be connected to the planar element by only a single span. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
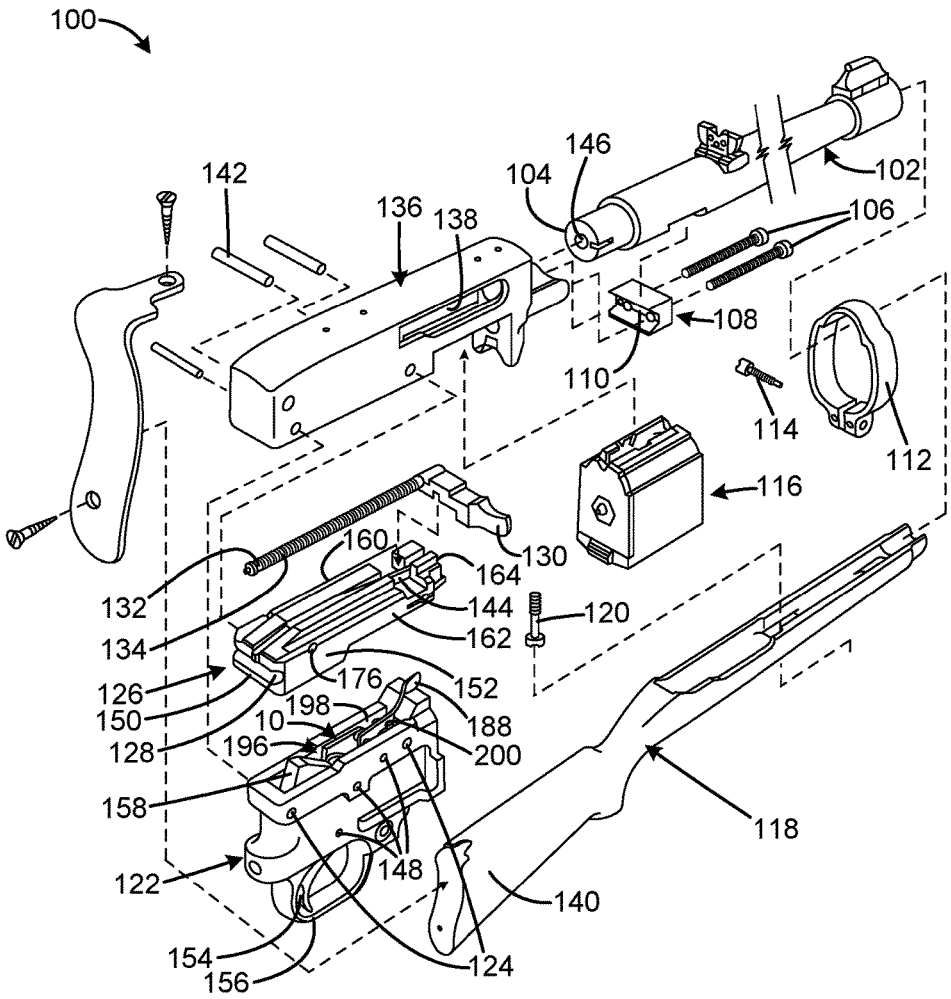
FIG. 1 PRIOR ART
FIG. 1 is a top isometric exploded view of a Ruger® 10/22® rifle of the prior art with the current embodiment of the gun part with integral spare extractor constructed in accordance with the principles of the present invention replacing the Ruger® 10/22® rifle's original equipment bolt lock.
Figure 3:
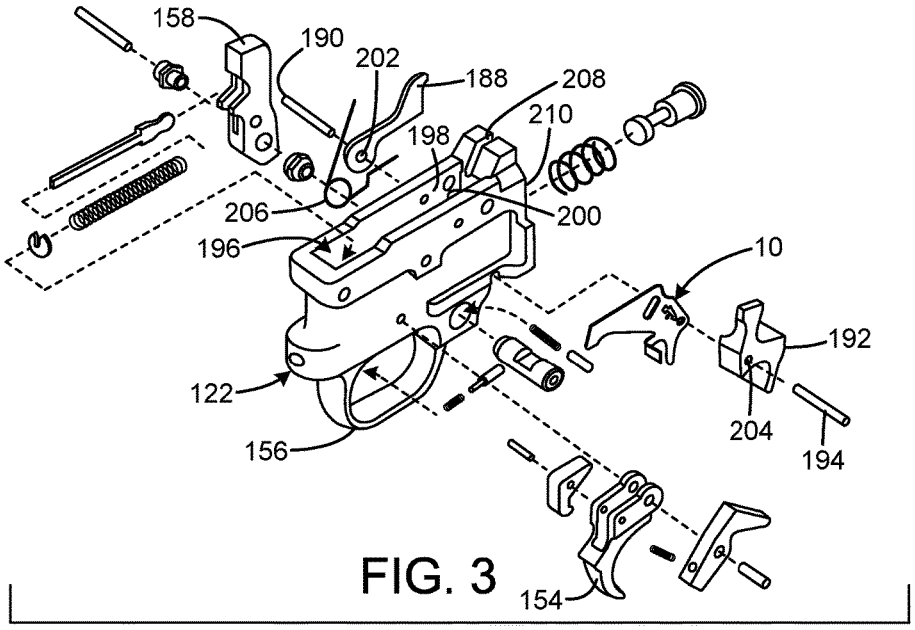
FIG. 3 is a top isometric exploded view of a Ruger® 10/22® rifle's bolt assembly of the prior art with the current embodiment of the gun part with integral spare extractor constructed in accordance with the principles of the present invention replacing the Ruger® 10/22® rifle's original equipment bolt lock.
Figure 2:
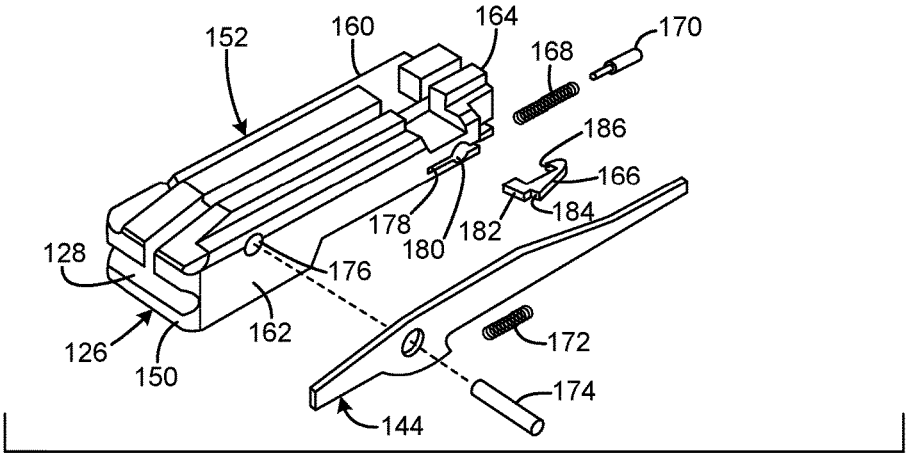
FIG. 2 PRIOR ART
FIG. 2 is a top isometric exploded view of a Ruger® 10/22® rifle's bolt assembly of the prior art.
Figure 4:
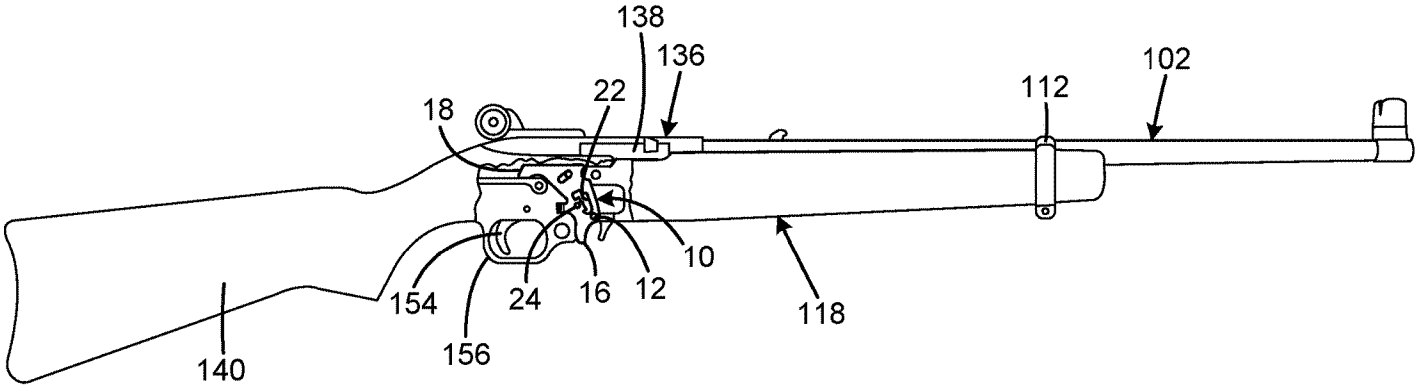
FIG. 4 is a right side cutaway view of the current embodiment of the gun part with integral spare extractor of the present invention installed in a Ruger® 10/22® rifle replacing the Ruger® 10/22® rifle's original equipment bolt lock.
Figure 5:
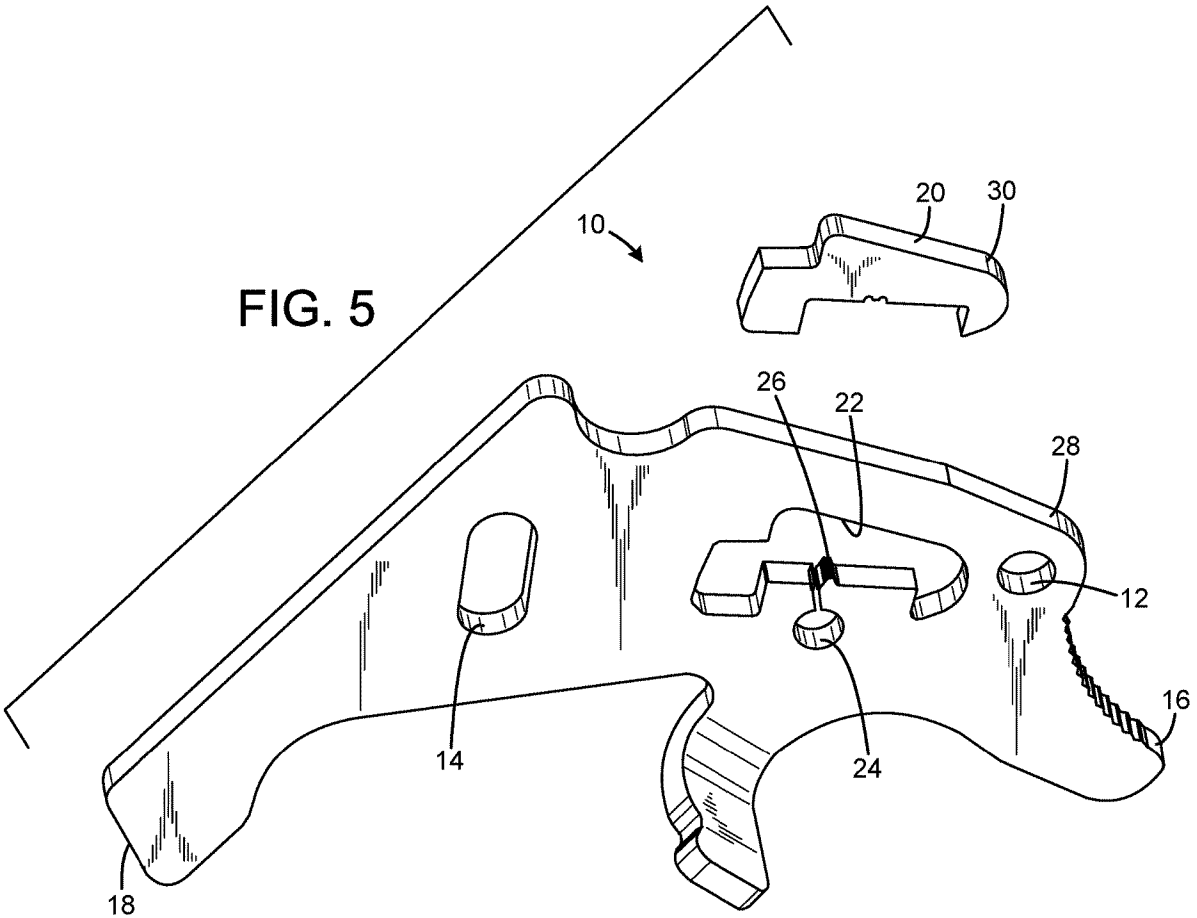
FIG. 5 is a top isometric view of the current embodiment of the gun part with integral spare extractor of the present invention with the spare extractor separated from the gun part.
Figure 6:
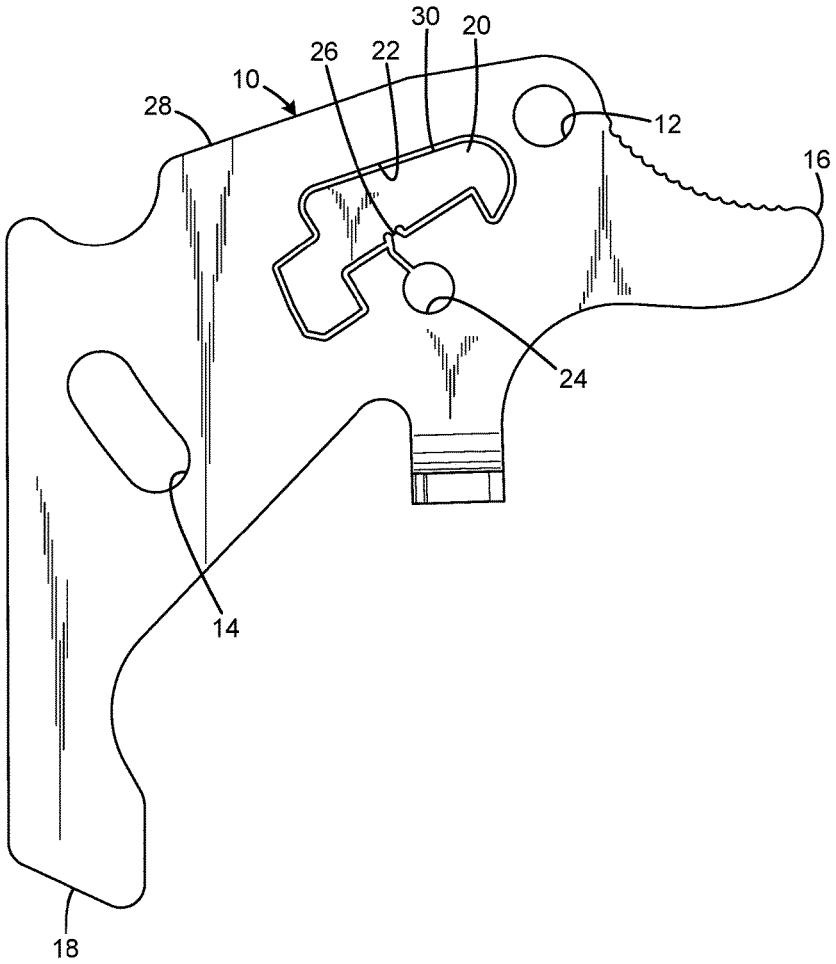
FIG. 6 is a right side view of the current embodiment of the gun part with integral spare extractor of the present invention.

An embodiment of the gun part with integral spare extractor of the present invention is shown and generally designated by the reference numeral 10.

FIGS. 3-6 illustrate the improved gun part with integral spare extractor 10 of the present invention. More particularly, the gun part with integral spare extractor is shown installed in a Ruger® 10/22® rifle in FIG. 4 and provides comparable functionality to the original equipment bolt lock (not shown). The gun part with integral spare extractor is part of the trigger guard assembly 122 that defines a channel 196 having a left side 198 and a right side 200. The gun part with integral spare extractor is held within the channel by a magazine latch pivot pin 194 and an ejector pin 190. The magazine latch pivot pin passes through aperture 12 in the gun part with integral spare extractor and aperture 204 of the magazine latch 192. The ejector pin passes through slot 14 in the gun part with integral spare extractor and aperture 202 in the ejector 188. The gun part with integral spare extractor is located on the left side of the channel adjacent to the ejector and the magazine latch.

The gun part with integral spare extractor 10 is a planar element having a first periphery 28 and form adapted to provide a first gun part function of preventing forward movement of the bolt as will be described. During normal operation of the rifle 100, the gun part with integral spare extractor remains in the down position shown in FIG. 4. In this position, the bolt 152 is free to reciprocate above the gun part with integral spare extractor to open and close, with the bolt being spring-biased to the closed position. Thus, no force is transmitted or received by the gun part with integral spare extractor during normal operation of the rifle. When finger pressure is applied to the lever portion 16 of the gun part with integral spare extractor with the bolt pulled all the way back, the gun part with integral spare extractor pivots about the magazine latch pivot pin 194 to an extent determined by the length of the slot 14. The tail portion 18 of the gun part with integral spare extractor protrudes above the trigger guard assembly 122 in the raised position. As a result, the bolt can be gently moved forward into contact with the tail portion, which serves as a bolt hold open element and subsequently prevents further forward movement of the bolt by selectably restraining the bolt. The tail portion is held in the raised position by forward pressure of the bolt against the tail portion produced by the recoil spring 134. To release the bolt, the bolt is pulled all the way back so the bolt lock spring 206 can return the gun part with integral spare extractor to the down position. The bolt is then again free to reciprocate above the gun part with integral spare extractor to open and close.

The gun part with integral spare extractor 10 includes an integral spare extractor 20 defined by a slot 22 and aperture 24, which are openings in the gun part with integral spare extractor. The slot is an elongated articulated opening/cut of consistent width in the current embodiment. The spare extractor has a periphery 30 adapted to provide a second gun part function, which is extracting unfired cartridges and positioning discharged cases as previously described. At least a portion of the periphery of the spare extractor is defined by the slot. The spare extractor is a detachable removable element that remains securely attached to the gun part with integral spare extractor by one or more small spans/tabs 26 of uncut material. The tabs are limited portions having a width less than the thickness of the spare extractor and less than the width of the slot in the current embodiment. The tabs are breakable without damage to the utility of the gun part with integral spare extractor or the spare extractor by manipulating the spare extractor to extract the spare extractor from the gun part with integral spare extractor. The spare extractor can then be installed in the hole 180 on the bolt 152 to replace a malfunctioning original equipment extractor 166. The gun part with integral spare extractor remains completely functional even after removal of the spare extractor because the gun part with integral spare extractor receives only a small force from the bolt in the raised position and is not subjected to repeated impacts. The spare extractor is positioned at an intermediate position of the gun part with integral spare extractor away from the peripheral edge of the gun part with integral spare extractor such that an enclosed aperture is defined by the slot upon removal of the spare extractor. The gun part with integral spare extractor, the original equipment bolt lock (not shown), and the original equipment extractor are all manufactured from 1/16-inch thick sheet steel. This makes the gun part with integral spare extractor easy to manufacture and completely functional when the spare extractor is both present and absent. A wide variety of manufacturing methods can be used to make the gun part with integral spare extractor, including stamping, waterjet, laser, and wire electrical discharge machining.

The gun part with integral spare extractor 10 ensures the user always has a spare extractor 20 available that cannot be forgotten or lost since it is installed in the rifle 100. To access the spare extractor, the user needs to partially disassemble the rifle by removing the stock 140 and separating the trigger guard assembly 122 from the receiver 136. This requires the use of commonly available tools. Once the trigger guard assembly is separate from the receiver, the user can access the gun part with integral spare extractor by removing both the ejector pin 190 and magazine release lever pin 194, thus releasing the gun part with integral spare extractor from the trigger guard assembly. The spare extractor can then be detached by manipulating the spare extractor with a small tool in such a way that the force applied breaks the tab 26.)

Although the gun part with integral spare extractor 10 remains fully functional after the spare extractor 20 is removed, a new gun part with integral spare extractor can be easily installed by partially disassembling the rifle 100 so the trigger guard assembly 122 is separated from the receiver 136. Removing the ejector pin 190 and the magazine release lever pin 194 releases the gun part with integral spare extractor from the trigger guard assembly. This enables replacement of the gun part with integral spare extractor with a new gun part with integral spare extractor to provide another spare extractor should it be needed in the future.

Figure 7:
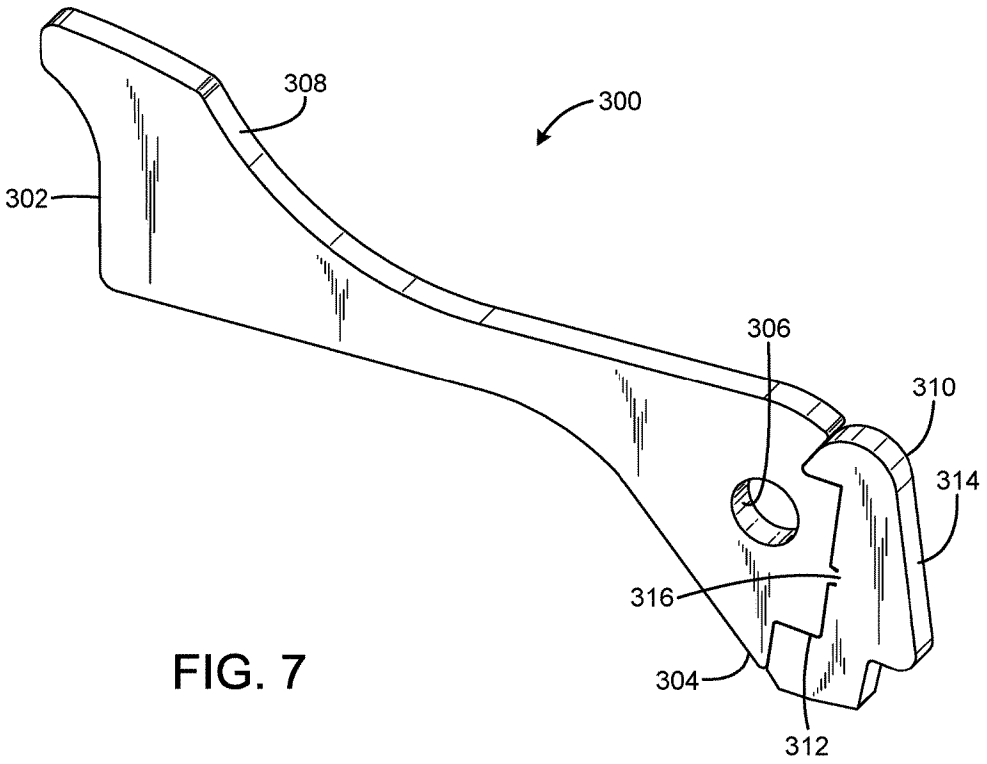
FIG. 7 is a top isometric view of an alternative embodiment of the gun part with integral spare extractor of the present invention where the gun part is an ejector.
Figure 8:
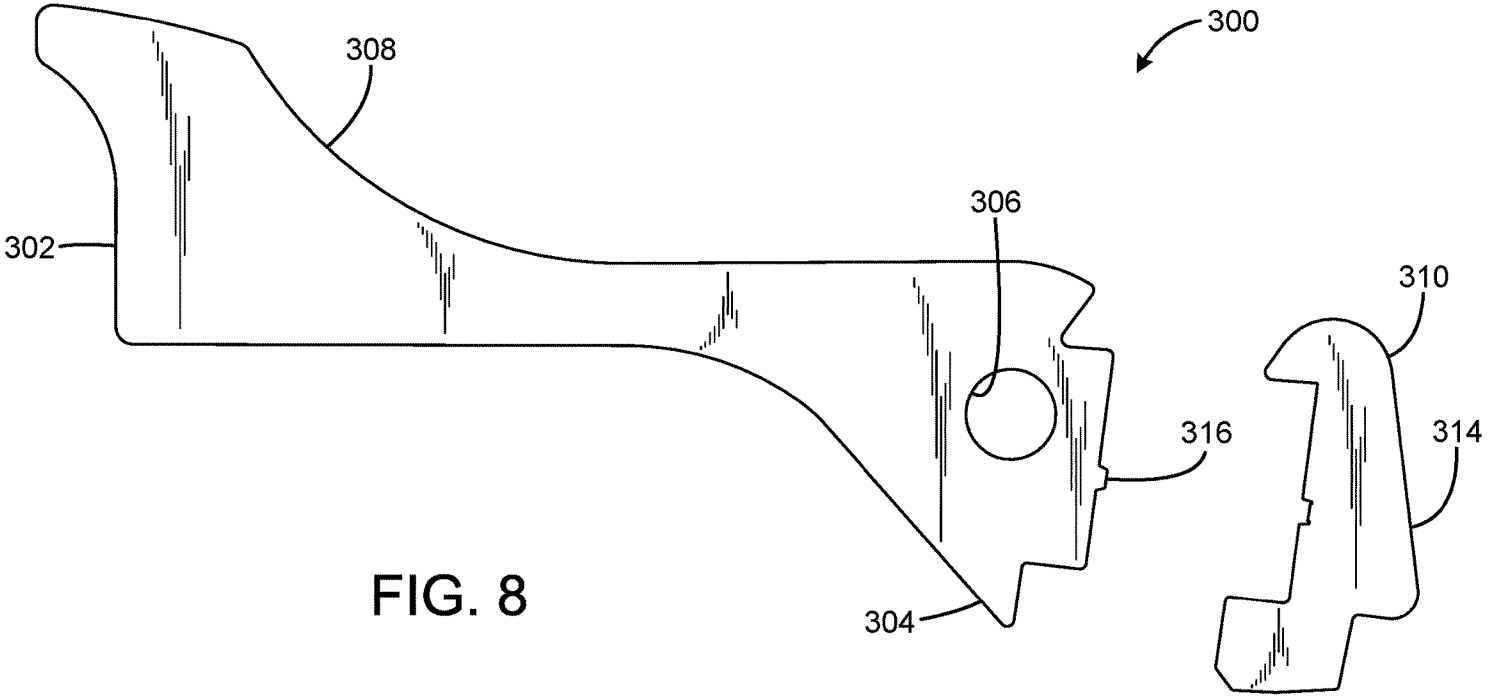
FIG. 8 is a left side view of the alternative embodiment of the alternative embodiment of the gun part with integral spare extractor of the present invention where the gun part is an ejector with the spare extractor separated from the gun part.

FIGS. 7-8 illustrate an alternative embodiment of the improved gun part with integral spare extractor 300 of the present invention. More particularly, the gun part with integral spare extractor provides comparable functionality to the original equipment ejector 188 of a Ruger® 10/22® rifle shown in FIG. 3. The gun part with integral spare extractor is part of the trigger guard assembly 122 that defines a channel 196 having a left side 198 and a right side 200. The gun part with integral spare extractor has a front 302 received within a slot 208 in the front 210 of the trigger guard assembly. The gun part with integral spare extractor has a rear 304 that is held within the channel by an ejector pin 190 that passes through aperture 306 in the gun part with integral spare extractor. The gun part with integral spare extractor is located on the left side of the channel.

The gun part with integral spare extractor 300 is a planar element having a first periphery 308 and form adapted to provide a first gun part function of ejecting a discharged case from the rifle 100 as previously described in the discussion of the function of the original equipment ejector 188. During normal operation of the rifle 100, the discharged case is ejected by a protrusion in the left side of the feed lips of the magazine 116. The gun part with integral spare extractor 300 is physically blocked by the magazine during normal operation. The only way that the gun part with integral spare extractor can eject a round is if the magazine is removed from the rifle, and a previously chambered round is extracted. Thus, no force is transmitted or received by the rear 304 of the gun part with integral spare extractor during normal operation of the rifle.

The gun part with integral spare extractor 300 includes an integral spare extractor 310 defined by a slot 312, which is an opening in the gun part with integral spare extractor. In the current embodiment, the spare extractor in part defines the first periphery of the gun part with integral spare extractor. The slot is an elongated articulated opening/cut of consistent width in the current embodiment. The spare extractor has a periphery 314 adapted to provide a second gun part function, which is extracting unfired cartridges and positioning discharged cases as previously described. At least a portion of the periphery of the spare extractor is defined by the slot. The spare extractor is a detachable removable element that remains securely attached to the gun part with integral spare extractor by one or more small spans/tabs 316 of uncut material. The tabs are limited portions having a width less than the thickness of the spare extractor and less than the width of the slot in the current embodiment. The tabs can be broken without damage to the utility of the gun part with integral spare extractor or the spare extractor by manipulating the spare extractor to break off the spare extractor from the gun part with integral spare extractor. The spare extractor can then be installed in the hole 180 on the bolt 152 to replace a malfunctioning original equipment extractor 166. The gun part with integral spare extractor remains completely functional even after removal of the spare extractor because the rear 304 of the gun part with integral spare extractor does not receive any force. The gun part with integral spare extractor, the original ejector 188, and the original equipment extractor are all manufactured from 1/16-inch thick sheet steel. This makes the gun part with integral spare extractor easy to manufacture and completely functional when the spare extractor is both present and absent. A wide variety of manufacturing methods can be used to make the gun part with integral spare extractor, including stamping, waterjet, laser, and wire electrical discharge machining.

The gun part with integral spare extractor 300 ensures the user always has a spare extractor 310 available that cannot be forgotten or lost since it is installed in the rifle 100. To access the spare extractor, the user needs to partially disassemble the rifle by removing the stock 140 and separating the trigger guard assembly 122 from the receiver 136. This requires the use of common tools. Once the trigger guard assembly is separate from the receiver, the user can access the spare extractor by removing the ejector pin 190. The spare extractor can be detached from the gun part with integral spare extractor by placing the forward portion of the gun part with integral spare extractor in the slot 208 of the trigger guard assembly 122 and applying a force in such a way that the tab 316 breaks.

Although the gun part with integral spare extractor 300 remains fully functional after the spare extractor 310 is removed, a new gun part with integral spare extractor can be easily installed by partially disassembling the rifle 100 so the trigger guard assembly 122 is separated from the receiver 136. Removing the ejector pin 190 releases the gun part with integral spare extractor from the trigger guard assembly. This enables replacement of the gun part with integral spare extractor with a new gun part with integral spare extractor to provide another spare extractor should it be needed in the future.

While current embodiments of the gun part with integral spare extractor has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gun part comprising:

a planar element having a first periphery and form configured to provide a first gun part function;

the planar element including an integral and detachable removable element having a periphery configured to provide a second gun part function; and at least a portion of the periphery of the removable element being defined by an elongated articulated opening defined in the planar element such that the removable element is connected only by a limited portion that is breakable without affecting the first gun part function of the planar element and the second gun part function the removable element.

2. The gun part of claim 1 wherein the removable element is positioned away from the first periphery such that an enclosed aperture is defined by the opening upon removal of the removable element.

3. The gun part of claim 1 wherein the opening is an articulated cut.

4. The gun part of claim 3 wherein the cut has a consistent width.

5. The gun part of claim 1 wherein the removable part is connected to the planar element by only a single span.

6. The gun part of claim 5 wherein the span has a width less than the thickness of the planar element.

7. The gun part of claim 5 wherein the opening has an opening width and the span has a width less than the opening width.

8. The gun part of claim 1 wherein the planar element is a bolt hold open element for a firearm having a spring-biased reciprocating bolt, and wherein the first gun part function is to selectably restrain the bolt.

9. The gun part of claim 1 wherein the removable element is an extractor.

10. The gun part of claim 1 wherein the removable element in part defines the first periphery.

11. A firearm comprising:

a frame;

a bolt adapted to reciprocate with respect to the frame between a battery condition and a position;

an extractor connected to the bolt and adapted to engage a case rim;

a bolt hold-open element connected to the frame and movable between a rest position in which reciprocation of the bolt is enabled and an actuated position in which the bolt is restrained in the retracted position;

the bolt hold-open element including an integral spare extractor connected only by a limited span that is breakable without affecting the utility of the bolt hold-open element and the extractor.

12. The gun part of claim 11 wherein the extractor is positioned at an intermediate position of the bolt hold open element away from a peripheral edge of the bolt hold open element such that an enclosed aperture is defined by the opening upon removal of the removable element.

13. The gun part of claim 11 wherein the opening is an articulated cut.

14. The gun part of claim 13 wherein the cut has a consistent width.

15. The gun part of claim 11 wherein the removable part is connected to the planar element by only a single span.

16. The gun part of claim 15 wherein the span has a width less than the thickness of the planar element.

17. The gun part of claim 15 wherein the opening has an opening width and the span has a width less than the opening width.

18. The gun part of claim 11 wherein the bolt hold open element configured to selectably restrain the bolt.

19. The gun part of claim 11 wherein the extractor is a removable element.

* * * * *